US008915031B2

(12) United States Patent
Dixon

(10) Patent No.: US 8,915,031 B2
(45) Date of Patent: Dec. 23, 2014

(54) DOOR MOUNTING SYSTEM

(75) Inventor: Alan Dixon, Brookings, SD (US)

(73) Assignee: Larson Manufacturing Company of South Dakota, Inc., Brookings, SD (US)

( * ) Notice: Subject to any disclaimer, the term of this patent is extended or adjusted under 35 U.S.C. 154(b) by 576 days.

(21) Appl. No.: 12/272,408

(22) Filed: Nov. 17, 2008

(65) Prior Publication Data

US 2009/0126278 A1 May 21, 2009

Related U.S. Application Data

(60) Provisional application No. 61/003,344, filed on Nov. 16, 2007.

(51) Int. Cl.
*E06B 3/34* (2006.01)
*E06B 1/60* (2006.01)

(52) U.S. Cl.
CPC ..... *E06B 1/6053* (2013.01); *E06B 1/6023* (2013.01)
USPC ..... 52/204.1

(58) Field of Classification Search
CPC ..... E06B 1/342; E06B 1/34; E06B 1/56; E06B 1/60; E06B 1/603; E06B 1/52; E06B 1/04; E04F 13/0733; E04F 19/0495; E04F 19/064
USPC ..... 52/211, 213, 717.01, 718.02; 49/504; 16/249
See application file for complete search history.

(56) References Cited

U.S. PATENT DOCUMENTS

| | | | | | |
|---|---|---|---|---|---|
| 734,635 | A | * | 7/1903 | Tribe | 16/235 |
| 1,179,597 | A | * | 4/1916 | Zahner | 52/213 |
| 1,241,243 | A | * | 9/1917 | Otte | 52/211 |
| 1,743,273 | A | * | 1/1930 | Hammer | 312/242 |
| 2,835,933 | A | * | 5/1958 | Evans | 52/211 |
| 3,235,917 | A | * | 2/1966 | Skubic | 49/468 |
| 3,296,743 | A | * | 1/1967 | Curl | 49/382 |
| 3,317,167 | A | * | 5/1967 | Becker et al. | 248/73 |
| 3,710,839 | A | | 1/1973 | Andres | |
| 3,771,275 | A | * | 11/1973 | Seckerson | 52/508 |
| 4,077,160 | A | | 3/1978 | Stewart | |
| 4,106,238 | A | * | 8/1978 | Bonello | 49/382 |
| 4,754,524 | A | | 7/1988 | Bullock et al. | |
| 5,187,898 | A | | 2/1993 | McKann | |
| 5,327,684 | A | * | 7/1994 | Herbst | 49/506 |
| 5,483,771 | A | | 1/1996 | Herbst | |

(Continued)

FOREIGN PATENT DOCUMENTS

JP 08121051 5/1996

*Primary Examiner* — Christine T Cajilig
(74) *Attorney, Agent, or Firm* — Kagan Binder, PLLC

(57) ABSTRACT

An apparatus and method for temporarily mounting a side rail such as a z-bar during installation of a door assembly. The apparatus includes a mounting structure cooperating with a fastener to accurately position the side rail at a location on a structural member such as a door jamb. In the case of hinge-side side rails, the side rail may be aligned without the door attached thereto while establishing the location for the fastener. The mounting structure may aid in the proper placement of the fastener in the structural member. Once the fastener is in place, the side rail can be removed from the structural member without removing the fastener. The door may then be attached to the side rail to form a door/side rail assembly. The door/side rail assembly is then temporarily engaged with the fastener for accurate positioning while the side rail is affixed to the structural member.

10 Claims, 8 Drawing Sheets

(56) References Cited

U.S. PATENT DOCUMENTS

| | | | | |
|---|---|---|---|---|
| 5,752,356 | A * | 5/1998 | Miklavic et al. | 52/718.02 |
| 5,775,400 | A | 7/1998 | Wilkinson | |
| 5,860,250 | A | 1/1999 | Hill et al. | |
| 6,088,966 | A | 7/2000 | Kenkel | |
| D467,007 | S | 12/2002 | Daudet et al. | |
| 7,228,597 | B2 * | 6/2007 | Gerali et al. | 16/382 |
| D595,866 | S | 7/2009 | Kibbel et al. | |
| 2004/0187427 | A1 | 9/2004 | Skublevitz | |
| 2006/0150524 | A1 | 7/2006 | Kibbel et al. | |
| 2007/0209299 | A1 | 9/2007 | El Etel | |
| 2008/0163554 | A1 | 7/2008 | Kibbel et al. | |

* cited by examiner

DOOR MOUNTING SYSTEM

RELATED APPLICATIONS

This application claims the benefit of U.S. Provisional Patent Application No. 61/003,344, filed Nov. 16, 2007, which is hereby incorporated by reference herein in its entirety.

FIELD OF THE INVENTION

The present invention relates to assemblies for doors. More particularly, the present invention relates to structures and methods for installing side rails for door assemblies, such as z-bars.

BACKGROUND OF THE INVENTION

A door assembly, such as a storm door, often involves the use of what is commonly referred to as a "z-bar." The z-bars are typically formed to mount the door assembly to the jambs or exterior trim of the entry door. Normally there are two z-bars in such an installation: a hinge-side z-bar and a latch-side z-bar. The hinge-side z-bar is so named because it accommodates hinges for pivotal mounting of the door. The latch-side z-bar is so named because it is located adjacent the latch side of the door and may serve as part of a system to latch the door in a closed position.

Mounting a door having a z-bar or z-bar assembly, particularly the hinge-side z-bar with the door attached, can be problematic. The hinge-side z-bar and door may be placed in the opening of the door casing, and the hinge-side z-bar attached to the appropriate jamb. However, the combination of z-bar and attached door may prove to be unwieldy, particularly for an inexperienced installer, resulting in misalignment. Alternatively, the z-bar may be detached from the door and mounted to the casing, but this necessitates either mounting the door to the hinges thereafter with the z-bar in place, or dismounting the z-bar and accompanying fasteners, reattaching the z-bar to the door, and then realigning the z-bar in the previous mounting arrangement and with the door present. These scenarios may require two people to mount the door properly.

There is a need in the industry for a z-bar assembly that is configured for easier installment of the door within the casing.

SUMMARY OF THE INVENTION

Various embodiments of the invention provide for a mounting structure within, on or integral to a door side rail such as a z-bar that cooperates with a fastener or fasteners to hold the side rail in place temporarily while the side rail is permanently affixed to a door opening. The mounting structure may serve as a guide or enable the placement of guide marks for accurate positioning of a fastener that temporarily holds the side rail/door assembly (hinged door assembly) within the door opening. The side rail may further be configured to enable release from the structural member without removing the fastener. The mounting structure enables a single, inexperienced installer to accurately position the hinged door assembly in the door opening.

In one embodiment, a method is disclosed wherein the user positions a "doorless" hinge-size side rail (that is, a hinge-side side rail that does not have a door attached thereto) in a desired orientation on a door opening frame member such as a door jamb. The hinge-side side rail may then be used to guide or mark a location for placement of a fastener. The fastener may be installed so that the hinge-side side rail is captured but not held fast by the fastener, thus enabling removal of the hinge-size side rail while the fastener remains in place. The hinge-side side rail may then be removed and a door attached thereto. The hinged door assembly may then be mounted to the fastener, which holds the hinged door assembly temporarily in place while the side rail is permanently affixed to the door opening frame member.

Structurally, the mounting structure may include a through-hole or aperture of various shapes such as a round, a square, a triangle, a diamond, a keyhole or any other geometry that enables passage of a fastener head therethrough. In some embodiments, the mounting structure may include a hanger structure affixed to the side rail. The hanger structure may include projections that may be used to form indentations on the door opening frame member for location of the fastener with side rail removed from the door opening frame member.

DETAILED DESCRIPTION

Figure 1:
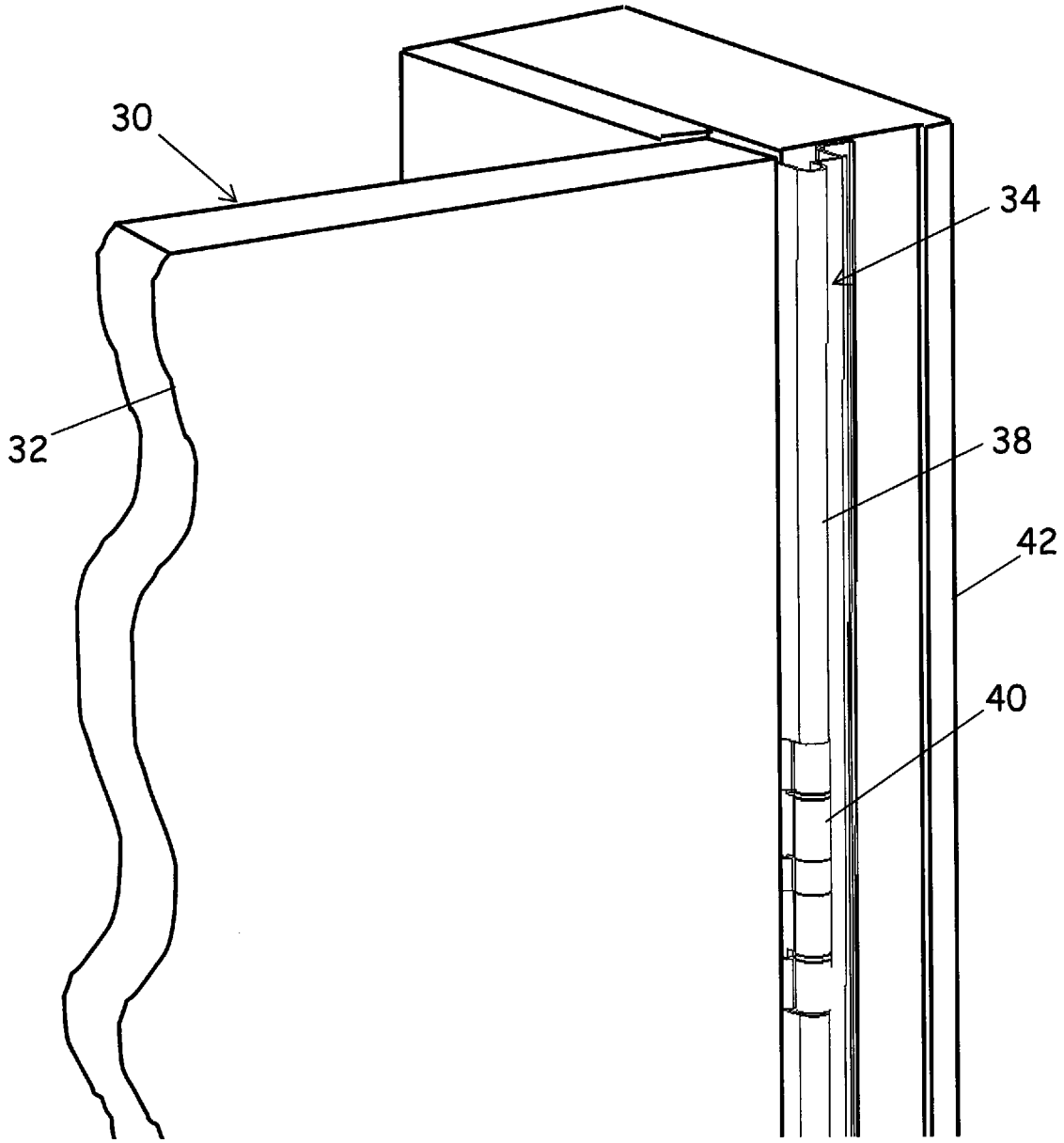
FIG. 1 Prior Art
FIG. 1 is a partial perspective view of a hinge-side z-bar and door.
Figure 2A:
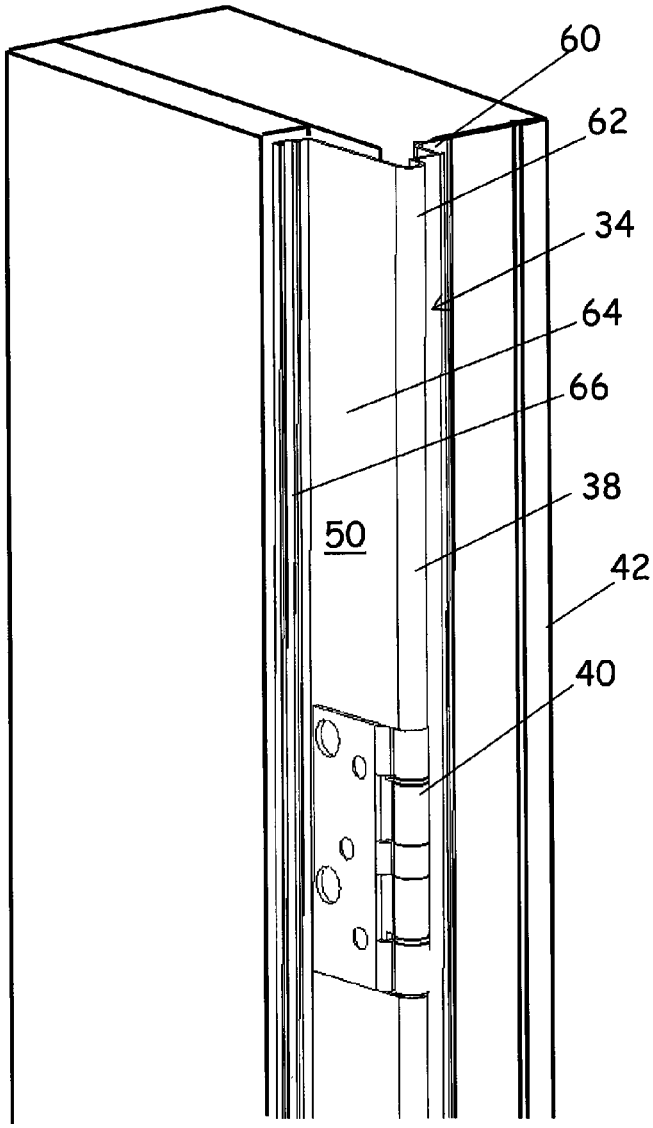
FIG. 2A Prior Art
FIGS. 2A and 2B are perspective views of the hinge-side z-bar of FIG. 1 with the door removed.
Figure 2B:
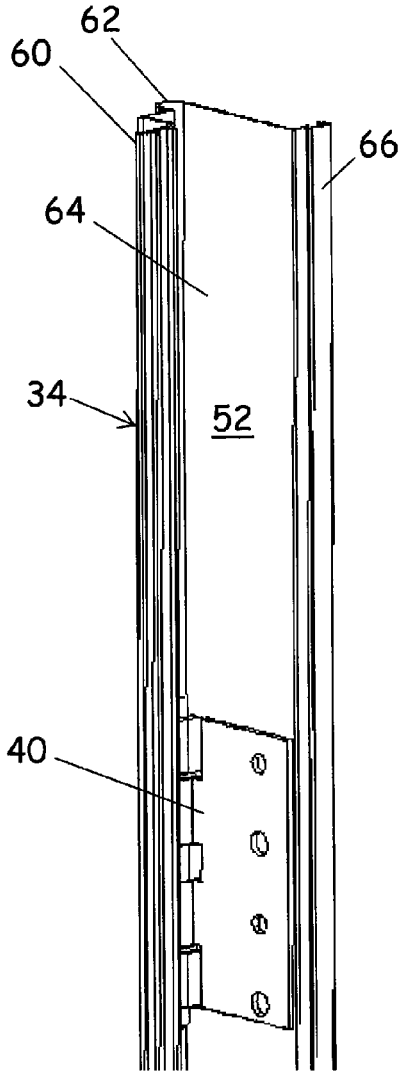
FIG. 2B Prior Art

Referring to FIGS. 1, 2A and 2B, a standard hinged door assembly 30 that includes a door 32 operatively coupled with a hinge-side z-bar assembly 34 is depicted. The hinge-side z-bar assembly 34 includes a z-bar 38 and a plurality of hinge members 40 (only one depicted). The hinged door assembly 30 is mounted to a structural member 42 such as a door jamb.

The z-bar 38 may be characterized as having an outward-facing surface 50 that faces away from the structural member 42 (FIG. 2A), as well as an inward-facing surface 52 that faces toward the structural member 42 (FIG. 2B). The z-bar 38 may also be characterized as having a flange portion 60, a barrel portion 62, a web portion 64 and a projecting portion 66.

Mounting the standard hinged door assembly 30 can be problematic, particularly for one who is inexperienced in the installation of doors. Generally, the hinged door assembly 30 is placed in the opening of the door casing, and the hinge-side z-bar assembly 34 attached to the structural member 42. However, the hinged door assembly 30 may be unwieldy, resulting in misalignment. Alternatively, the hinge-side z-bar assembly 34 may be detached from the door 32 and mounted to the structural member 42, but this necessitates either mounting the door 32 to the hinge members 40 thereafter with the z-bar assembly 34 in place, or dismounting the z-bar assembly 34 and accompanying fasteners, reattaching the z-bar assembly 34 to the door 32, and then realigning the z-bar assembly 34 in the previous mounting arrangement and with the door 32 mounted thereto. These scenarios may be time consuming and may require two people to mount the door properly.

Figure 3:
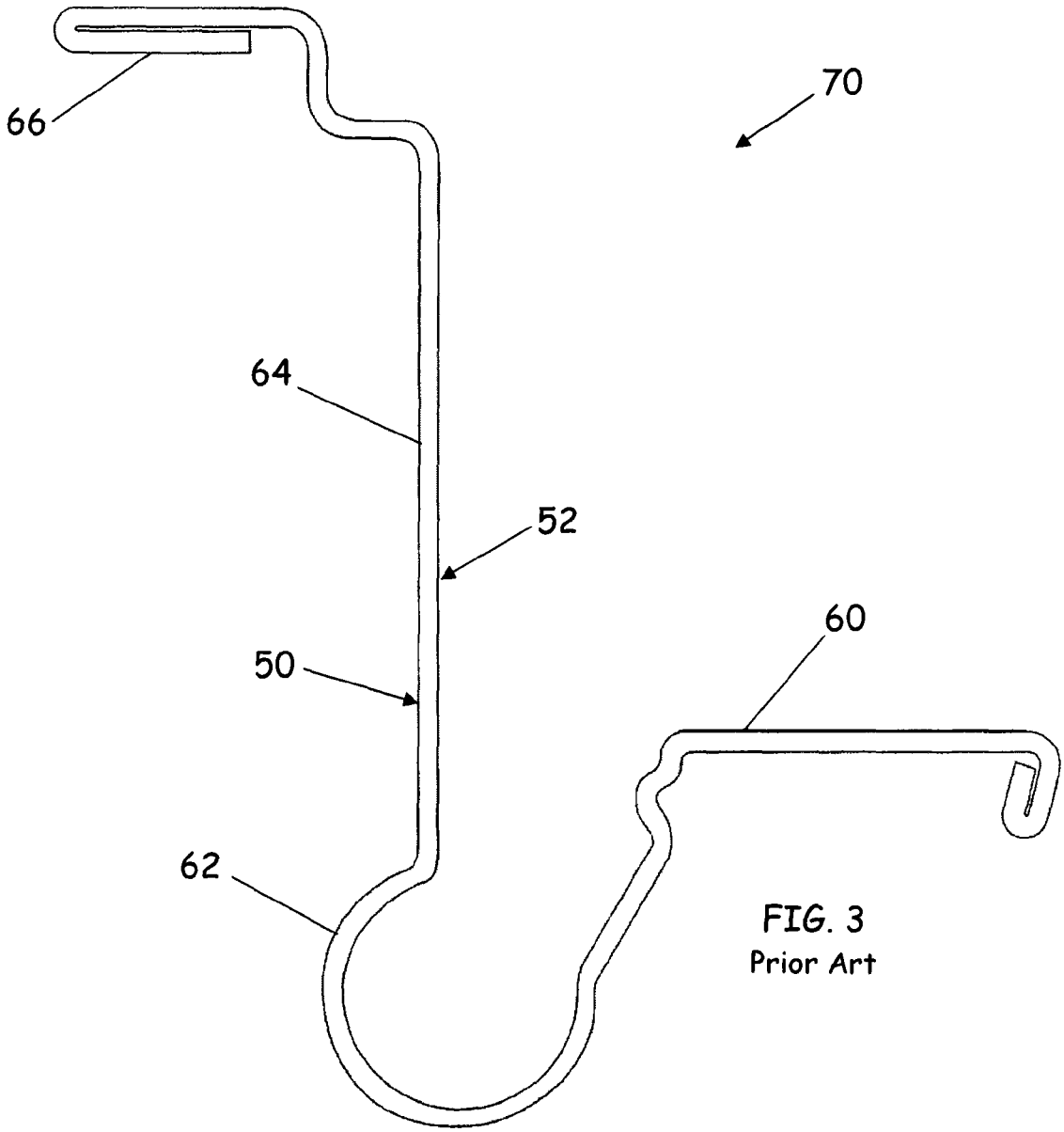
FIG. 3 Prior Art
FIG. 3 is a top view of a standard z-bar.
Figure 4:
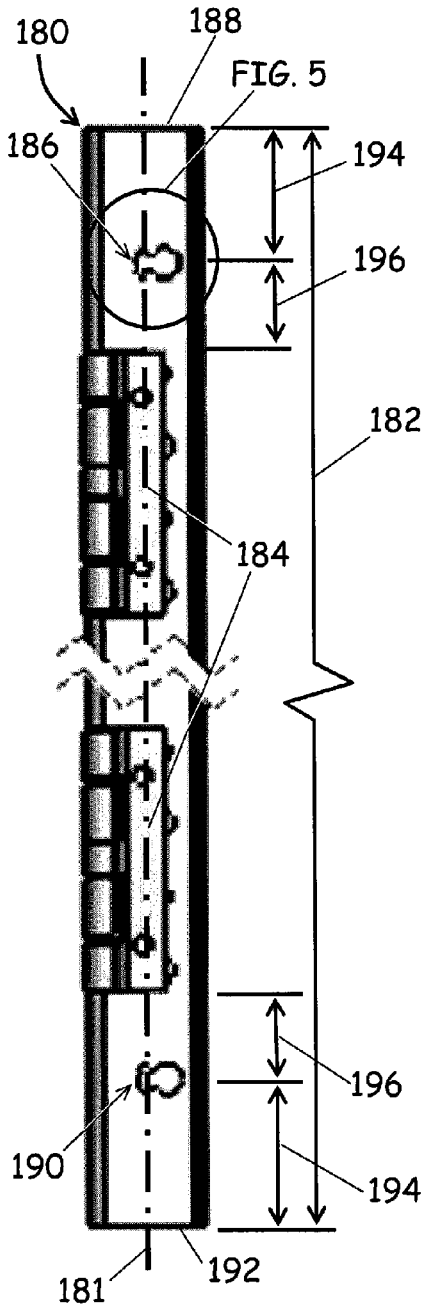
FIG. 4 is a partial plan view of a z-bar having lateral slots in an embodiment of the invention.
Figure 5:
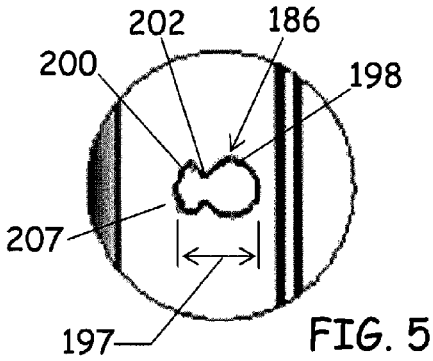
FIG. 5 is an enlarged partial view of the through slot of FIG. 4.

Referring to FIG. 3, a standard z-bar 70 is depicted in isolation to more clearly identify the components, which are numbered the same as for the z-bar 38 of FIGS. 1, 2A and 2B. The flange portion 60 generally provides registration of the z-bar on the outward-facing surface of the structural member 42, and may be secured to the outward-facing surface by gluing or by driving fasteners through the flange portion. The barrel portion 62 may provide structure for mounting the barrel or knuckle portion of a hinge member on hinge-side z-bars, or simply provide a uniform or symmetrical complimentary appearance for latch-side z-bars. The web portion 64 typically extends along a face of the structural member to define the depth of the z-bar. The projecting portion 66 may serve as a registration for the door 32 to seat against, and typically houses weather stripping (not depicted) for insulation purposes. Additional details regarding z-bars are provided at U.S. Patent Application Publication No. 2008/0163554, assigned to the assignee of the present application, the disclosure of which is incorporated by reference herein except for express definitions contained therein.

While the figures and much of the present application discussion is directed to applications that utilize z-bars, it is understood that the invention is not limited to implementation with z-bars. More generally, the invention can also be implemented with what is hereinafter referred to as "side rails" that mount to a side or corner of a structural member and may or may not include all the features of a z-bar. For example, a side rail for use on the latch side of a door may be void of a barrel portion, as no hinge is to be supported thereon. Other side rails may not include a flange portion, relying instead, for example, on mounting the side-rail with fasteners that pass through or are otherwise coupled with the web portion 64 for attachment. Still other side rails may cooperate with other structures for registration of the door when in the closed position, thereby not requiring or including a projecting portion. Accordingly, a "side rail" is a device that operatively couples with a door to provide either a hinge-side connection or a latch-side connection with the door, and may be void of the various aspects that are not required for the hinge-side or latch-side functionality.

Referring to FIGS. 4 through 8, a slotted z-bar 180 having a longitudinal axis 181, an overall length 182 and a plurality of hinge members 184 operatively coupled thereto is depicted in an embodiment of the invention. In this embodiment, the z-bar 180 includes a first through slot 186 formed on the web portion 64 of the z-bar 180 proximate a first end 188 of the z-bar 180, as well as a second through slot 190 proximate a second end 192. The through slots 186, 190 may be located a distance 194 from the respective end 188, 192 and a distance 196 from the hinge member 184 nearest the respective end 188, 192. While the FIG. 4 configuration depicts the through slots 186 and 190 as proximate the ends 188 and 189, respectively, the slots may be located anywhere on the z-bar 180 (e.g. between the hinge members 184, not depicted).

The through slots 186, 190 may be characterized as having a major length 197 and a varying width, and may each be defined by the confluence of a large opening 198 that necks down to and is common with a smaller opening 200. A narrow portion 202 may be defined between the large opening 198 and the smaller opening 200. The large opening 198 may be sized larger than the diameter of a head 204 of a fastener 205, while the smaller opening 200 and narrow portion 202 are smaller than the diameter of the head 204. The through slots 186, 190 may be arranged so that the major length 197 is substantially perpendicular to the longitudinal axis 181.

The fastener 205 is further characterized as having a shaft portion 206 and may be any fastener available to the artisan, such as a cap screw with a pan head, flat head or hex head screw, or a nail. Headless fasteners may also be utilized and may implement retention hardware such as internal tooth retainers. Shaft portions that cooperate with removable head portions such as wing nuts may also be implemented.

Figure 6:
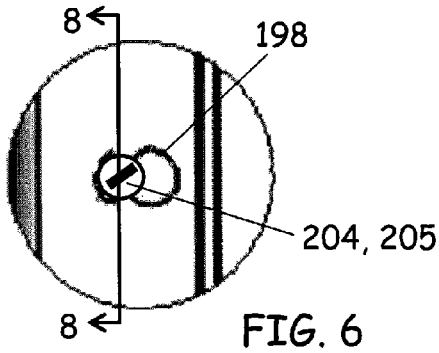
FIG. 6 is the enlarged partial view of FIG. 4 with a fastener passing therethrough.
Figure 7:
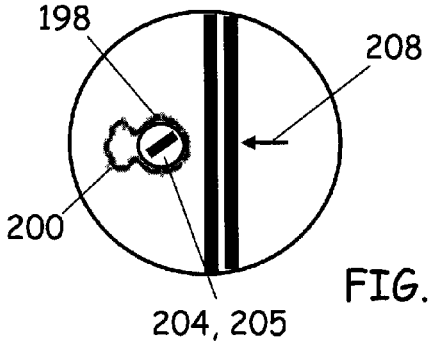
FIG. 7 is the enlarged partial view of FIG. 4 with the fastener aligned for removal of the z-bar.
Figure 8:
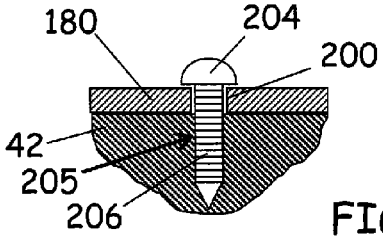
FIG. 8 is a partial sectional view of FIG. 6.
Figure 9:
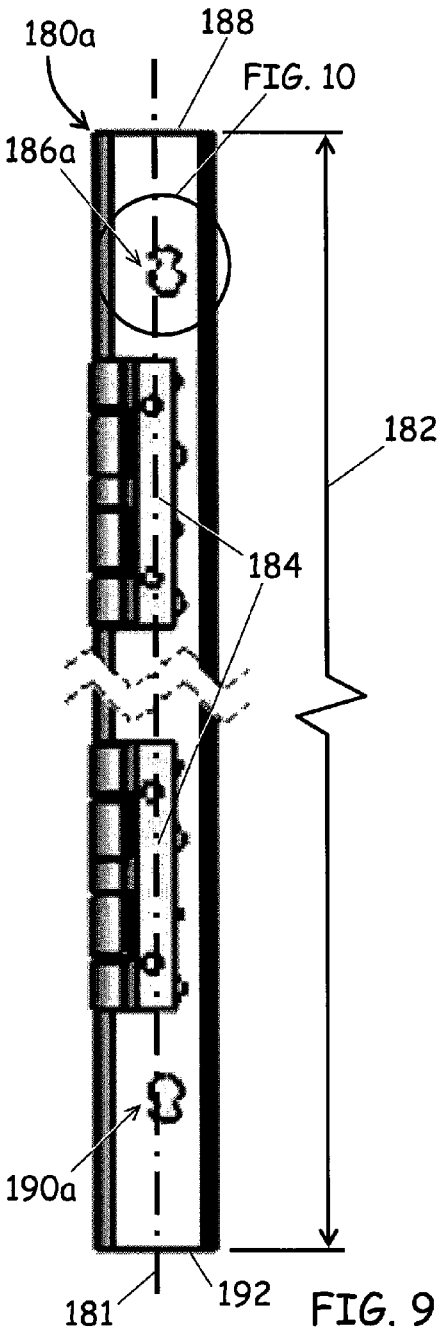
FIG. 9 is a partial plan view of a z-bar having longitudinal slots in an embodiment of the invention.
Figure 10:
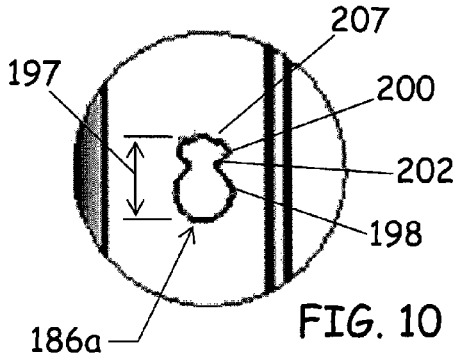
FIG. 10 is an enlarged partial view of the through slot of FIG. 9.
Figure 11:
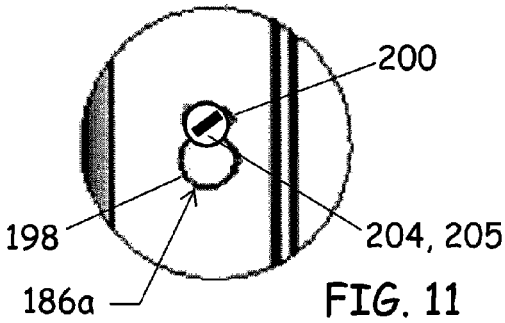
FIG. 11 is the enlarged partial view of FIG. 9 with a fastener passing therethrough.
Figure 12:
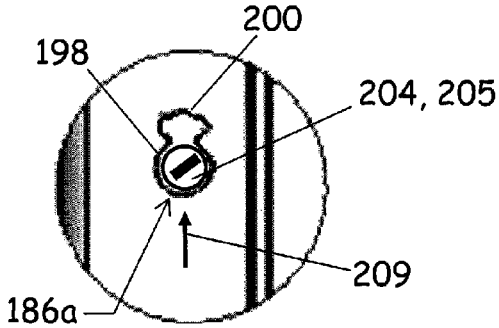
FIG. 12 is the enlarged partial view of FIG. 9 with the fastener aligned for removal of the z-bar.

In operation, the large opening 188 enables the head 204 to pass therethrough, whereas the smaller opening 200 does not. As depicted in FIG. 6, the z-bar 180 may be affixed to the structural member 42 by placing the z-bar 180 in the desired location and installing the fastener through the smaller opening 200 and into the structural member 42 so that the head 204 is immediately adjacent or over a perimeter portion 207 about the smaller opening 200 (FIG. 8). By this structure and method, the z-bar 180 is used to locate the mounting position of the fastener 205. The head 204 may clear the structural member 42 enough to enable the z-bar 180 to slide freely on the structural member, or with slight contact to generate some friction. The z-bar 180 may then be slid in a lateral direction 208 (i.e. a direction substantially perpendicular to the longitudinal axis 181) until the head 204 is located in the large opening 198, as depicted in FIG. 7. The z-bar 180 may then be pulled away from the surface so that the large opening 198 passes by the perimeter of the head 204.

Referring to FIGS. 9 through 12, an alternative embodiment of a slotted z-bar 180*a* is depicted in an embodiment of the invention. The slotted z-bar 180*a* as depicted is similar in many respects to the slotted z-bar 180, with one notable exception: the slots 186*a* and 190*a* are arranged with the major length 197 substantially parallel to the longitudinal axis 181. In this configuration, the z-bar 180*a* is slid in a parallel direction 209 with respect to the longitudinal axis to align the head 204 with the large opening 198.

Structural embodiments of the invention that include two structures for hanging (e.g. through slots 186*a* and 190*a*), one each proximate the ends 188, 192, may be suitable for mounting on either a left or a right door jamb.

Figure 13:
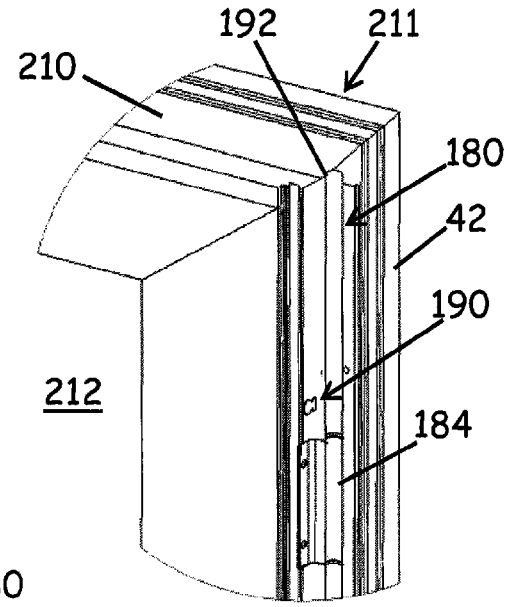
FIG. 13 is a partial perspective view of a z-bar aligned for mounting within a casing in an embodiment of the invention.
Figure 14:
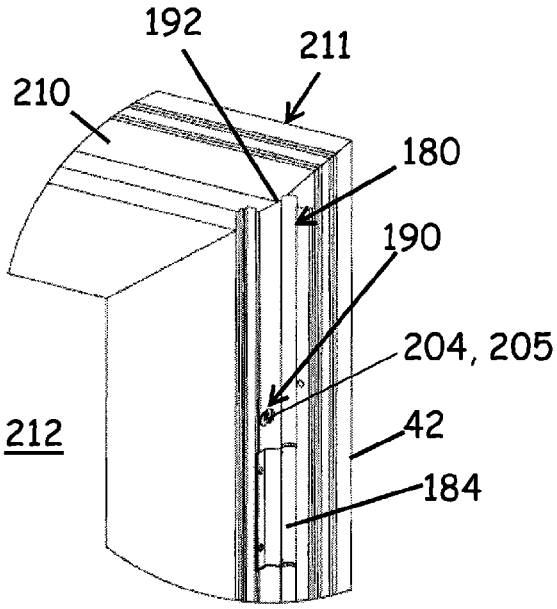
FIG. 14 is the aligned z-bar of FIG. 13 with a fastener passing through the through slot.
Figure 15:
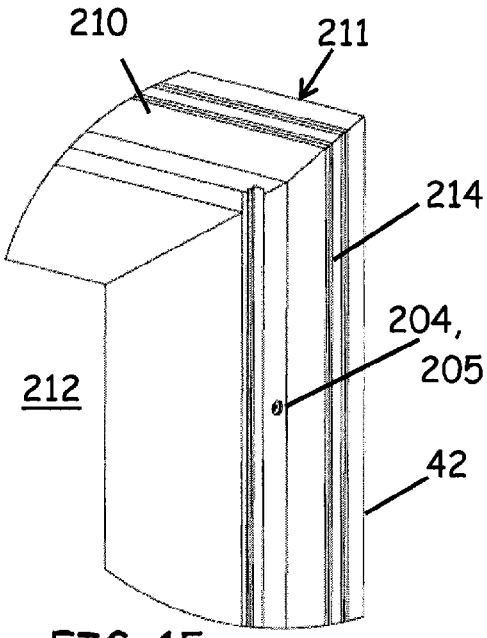
FIG. 15 is the partial perspective view of FIG. 13 with the z-bar removed.

Referring to FIGS. 13 through 15, a method of installing the z-bar 180 is depicted in an embodiment of the invention. The z-bar 180 may be placed on the structural member 42 so that the end 192 registers against a header portion 210 of a door casing 211, the casing 211 defining an opening 212 (FIG. 13). The z-bar 180 may be oriented so that the smaller opening 200 is oriented in closer proximity to an outer face 214 of the structural member 42 than is the large opening 198. The depth of the z-bar 180 within the opening may be established by registering the flange portion 60 against the outer face of the structural member 42. The fastener 205 may be aligned and installed to pass through smaller opening 200 of the through slot 186. Initially, the fastener 205 may be threaded into the structural member 42 so that the head 204 is brought into non-clamping contact with the z-bar 180. Herein, reference to "non-clamping contact" refers to intermittent or slight contact that generates only a low frictional force that releasably holds the z-bar 180 in contact with the structural member 42. The z-bar 180 may be brought forward and until the large opening 198 is aligned with the fastener 205. The z-bar 180 may then be moved clear of the fastener 205 and removed from the opening 212. The fastener 205 may be left in the structural member 42 after removal of the z-bar 180 (FIG. 15).

The z-bar 180 may be attached to the door 32 remote from the opening 212 before lifting the door 32 with z-bar 180 back into the opening 212 (not depicted). The large opening 198 of the through slot 186 may then be aligned with and slid over the fastener 205 in the structural member 42, and the z-bar 180 registered against the outer face of the structural member 42. With the added weight of the door, the z-bar may settle a fraction of an inch (e.g. 1/16-in.) thereby enabling room for a drip cap to be installed on the underside of the header portion 210. The door 32 is now aligned at the proper height and depth within the opening, and may be secured in place by tightening the fastener 205 against the z-bar 180 and/or by installing additional fasteners through the z-bar 180 (not depicted).

The method above eliminates the need for an installer simultaneously run fasteners through the z-bar while holding the door 32 in proper alignment. Instead, the fastener 205 serves as an alignment device and a holding device that holds the door 32 and z-bar 180 in place while the z-bar 180 is secured permanently in place.

Installation of the z-bar 180*a* (FIGS. 9 through 12) with slots 186*a*, 190*a* that are oriented with the major length 197 parallel to the longitudinal axis 181 may be similar to the procedures outlined above. It is noted that longitudinally-oriented slots may require additional space between the end of the z-bar (e.g. end 192) and the header portion 210 to enable the installer to lift the z-bar 180*a* for release. This additional space can expose a portion of the structural member 42 that may otherwise be covered by the z-bar. The exposed portion of the structural member 42 may be covered using a z-bar extender, such as disclosed in U.S. Patent Application No. 60/875,480, assigned to the assignee of the present application and included herein as an Appendix.

The use of through slots 186, 190 or other through-apertures may also be utilized on the flange portion 60 for the same effect (not depicted). Where laterally oriented through slots 186, 190 are utilized, the through slots 186, 190 may be formed on the front face of the flange portion 60 with the smaller opening 200 oriented toward the opening 212. A z-bar so configured could be slid toward the center of the opening 212 for release of the z-bar.

Referring to FIGS. 16A through 16D, alternative shapes to the generally keyhole shaped through-slots 186, 190 and 186*a*, 190*a* are presented in other embodiments of the invention. Viable shapes include, but are not limited to, a round 220 or a polygonal shape such as a square 222, a triangle 224 or a diamond 226 (FIGS. 16A through 16D, respectively) or any other geometry that enables passage of a fastener head therethrough. Example longitudinal axes 181 are superimposed on the shapes as well. A common factor with these geometries is that the head 204 of the fastener 205 can pass through a portion of the aperture.

Each of the FIGS. 16A through 16D depict the fastener 205 centered at a first position 232 (solid lines) that is justified to one side of the respective through-aperture when the z-bar 180 is in an aligned or final position. Alternatively, the fastener 205 can be centered at a second position 234 (phantom line), also at an aligned or final position, that is justified at the top of the respective through-aperture. Each of the first positions 232 enable release of the z-bar 180 by moving the z-bar laterally, i.e. in a direction perpendicular to the longitudinal axis 181. By contrast, each of the alternative positions 234 enable release of the z-bar 180 by moving the z-bar longitudinally, i.e. in a direction parallel to the longitudinal axis 181.

Functionally, the through-apertures of FIGS. 16A through 16D may be utilized in ways similar to the through-slots 186, 190 and 186*a*, 190*a*. For fasteners in the first position 232, the z-bar may be used to guide placement of the fastener 205 and then be released by a lateral or horizontal movement, akin to the description attendant FIGS. 4 through 8. For fasteners in the second position 234, the z-bar can also be used to guide placement of the fastener 205, but released by a longitudinal or vertical movement, akin to the description attendant FIGS. 9 through 12.

The round and square apertures 220, 222 can have some degree of adjustment after placement of the fastener 205. The round 220 can be sized large relative to the diameter of the shaft of fastener 205, thus enabling movement in a direction tangential to the round with minimal movement in the radial direction. Likewise, the alternative position 234 of the fastener 205 within the square 222 of FIG. 16B enables the z-bar to be adjusted laterally in both directions after placement of the fastener 205.

Figure 16A:
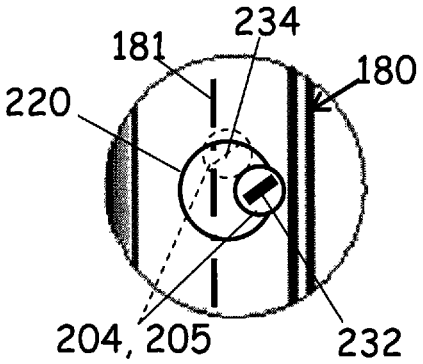
FIGS. 16A through 16D depict different shaped through-slots in various embodiments of the invention.
Figure 16B:
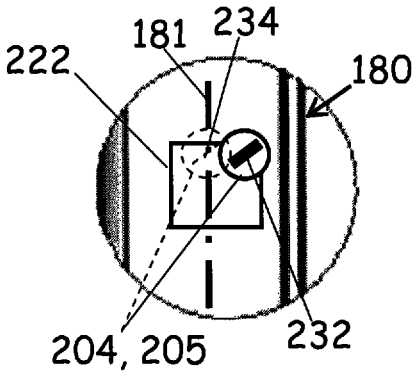
Figure 16C:
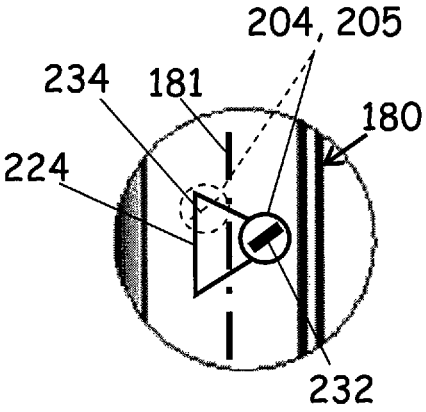
Figure 16D:
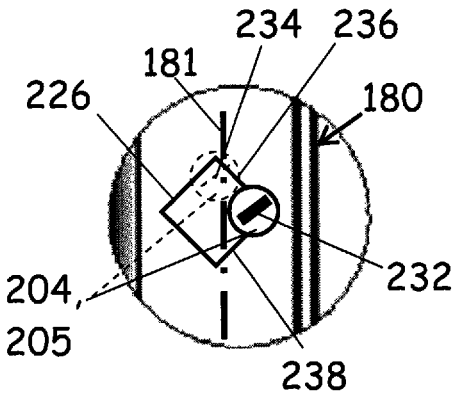
Figure 17:
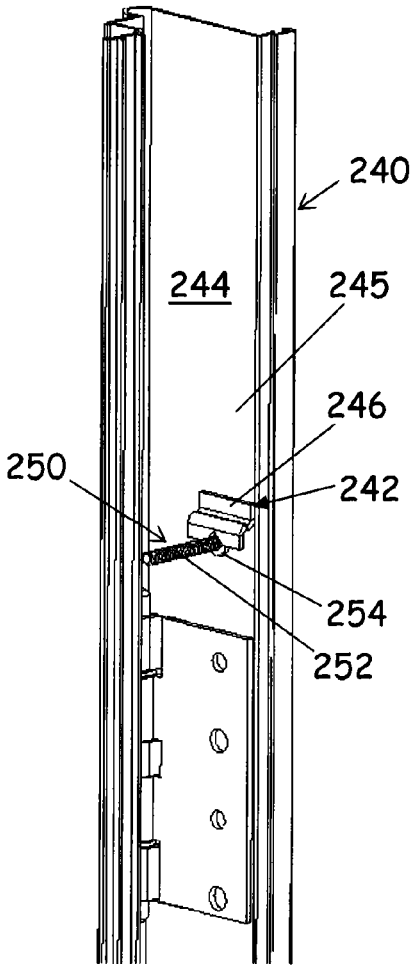
FIG. 17 is a partial view of a hinge-side z-bar with a hanger plate in an embodiment of the invention.

The apertures that have corners (i.e. the square 222, the triangle 224 and the diamond 226) can be utilized to provide a positive registration of the z-bar 180 with respect to the fastener 205 when the z-bar 180 is in a final position. For example, consider adjacent edges 236 and 238 of the diamond 226 (FIG. 16D). The fastener 205 may be positioned so that both of the adjacent edges 236 and 238 are in contact with the shaft of the fastener 205 when the z-bar 180 is in the desired alignment.

Figure 18:
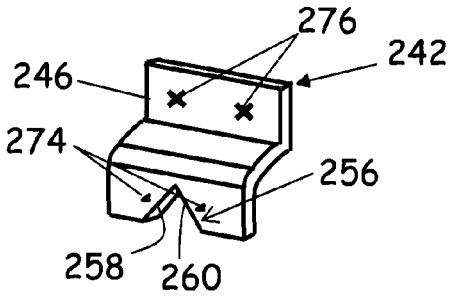
FIGS. 18 through 20 depict various hanger plates in isolation in various embodiments of the invention.
Figure 19:
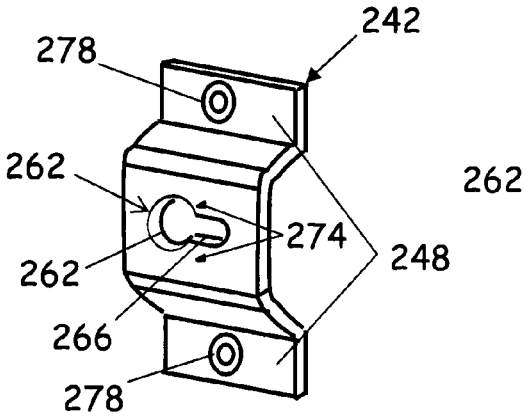
Figure 20:
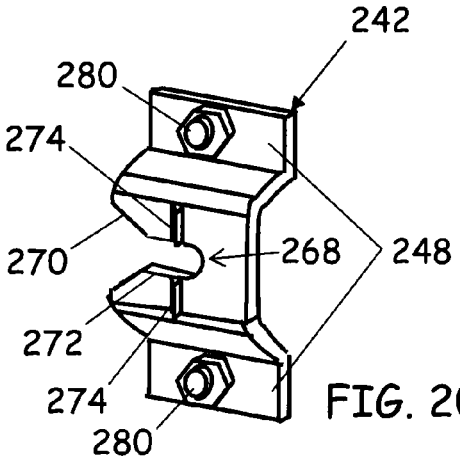

Referring to FIGS. 17 through 20, a z-bar 240 with a hanger plate 242 is depicted in an embodiment of the invention. The hanger plate 242 may be operatively coupled to an inward facing surface 244 of the web 245 of the z-bar 240 via a single flange 246 (FIGS. 17 and 18) or with a pair of flanges 248 (FIGS. 19 and 20). The hanger plate 242 may cooperate with a fastener 250 having a shaft portion 252 and a head portion 254 for suspension of the z-bar 240 from a structural member such as a door jamb (removed for clarity).

A variety of configurations may be implemented with the hanger plate 242 for securing the z-bar 240 during installation. For example, a v-notch 256 having inclined surfaces 258 and 260 can be formed on the hanger plate 242 so that the inclined surfaces 258, 260 register on the shaft 252 of the fastener 250 (FIG. 18). The head 254 of the fastener 250 prevents the z-bar 240 from sliding off the shaft 252 during installation of the z-bar 240. Other embodiments may include a closed slot 262 having a large diameter opening 264 and a smaller diameter opening 266, similar to the through slots 186, 190 (FIG. 19), an open-ended slot 268 with a divergent opening 270 and a narrow slot portion 272 (FIG. 20), or any other through aperture (e.g. FIGS. 16A through 16D) formed on the hanger plate 242 to cooperate with the fastener 250. The hanger plate 242 may include projections 274, such as a pair of barbs (FIGS. 18 and 19) or a ridge structure (FIG. 19), that extend away from the interior side 244 of the z-bar 240.

The hanger plate 242 may be mounted to the z-bar 240 in a variety of ways, such as by tack welds 276 (FIG. 18), rivets 278 (FIG. 19), threaded fastener 280 (FIG. 20), gluing (not depicted) or by other fastening techniques available to the artisan. The hanger plate 242 may also be integrally formed with the z-bar 240.

Functionally, the hanger plate 242 enables the z-bar to be mounted in ways similar to the through-holes or apertures without need to form a through-hole that passes through the web 245, and may thus provide better isolation of inclement elements such as water, hot/cold air and humidity. The absence of a through hole and attendant fastener head on the externally facing surface of the z-bar can also provide aesthetic advantages.

The projections 274 provide a mechanism for marking the structural member (e.g. a door jamb) onto which the z-bar 240 is to be mounted for proper placement of the fastener 250. The installer can align the z-bar 240 in a desired orientation on the structural member, then exert a force against the z-bar 240 such that the projections 274 leave an indentation on the structural member. Using the indentations as a guide, the fastener 250 can be located with sufficient accuracy for temporary mounting of the z-bar 240.

In one embodiment, a method of mounting the z-bar 240 may be as follows:

- position z-bar 240 at desired location against a door jamb
- press the z-bar 240 against the door jamb so structures leave indentation marks
- remove z-bar 240 from the door jamb
- identify the location on the door jamb where the fastener 250 will be installed (e.g. on a line between indentations, or according to some other characteristic of the indentation pattern)
- center punch the location on the door jamb where the fastener 250 will be installed, leaving a center punch mark
- place a gap gauge immediately adjacent the center punch mark
- mount fastener so that the head portion 254 of the fastener 250 comes into light or touching contact with the gap gauge to set proper gap dimension between head portion 250 and the jamb
- remove the gap gauge from between the head portion 254 and the jamb
- mount z-bar 240 to fastener using cooperating structure of the hanger The action that the installer undertakes to mount the z-bar 240 to the fastener 250 depends on the configuration of the hanger plate 242. For example, with the v-notch 256, the z-bar is lifted over the head portion 254 of the fastener 250 and hung on the shaft 252. With the closed slot 262, the installer aligns large diameter opening 264 over the fastener 250, pushes the z-bar 240 over the head portion 254 of the fastener 250 until it engages the jamb, and slides the z-bar 240 so that the shaft portion 252 is located in the smaller diameter opening 266. With the open-ended slot 268, the z-bar 240 is slid over the fastener 250, allowing the divergent opening 270 to guide the z-bar 240 until the z-bar 240 is positioned with the fastener 250 located in the narrow slot portion 272.

References to relative terms such as upper and lower, front and back, left and right, or the like, are intended for convenience of description and are not contemplated to limit the present invention, or its components, to any specific orientation. All dimensions depicted in the figures may vary with a potential design and the intended use of a specific embodiment of this invention without departing from the scope thereof.

Each of the additional figures and methods disclosed herein may be used separately, or in conjunction with other features and methods, to provide improved containers and methods for making and using the same. Therefore, combinations of features and methods disclosed herein may not be necessary to practice the invention in its broadest sense and are instead disclosed merely to particularly describe representative and preferred embodiments of the instant invention.

Because various modifications, substitutions, and changes of this invention may be made by one of skill in the art without departing from the spirit thereof, the invention is not limited to the embodiments illustrated and described herein. Rather, the scope of the invention is to be determined by the appended claims and their equivalents.

For purposes of interpreting the claims for the present invention, it is expressly intended that the provisions of Section 112, sixth paragraph of 35 U.S.C. are not to be invoked with respect to a given claim unless the specific terms "means for" or "step for" are recited in that claim.

What is claimed is:

1. A system for mounting a door to a structural member, the system comprising:

a z-bar member comprising:

a longitudinal axis extending along a length of the z-bar;

a web portion comprising a first plate for mounting to a first surface of the structural member; and a flange portion comprising a second plate for positioning against a second surface of the structural member, wherein the first plate is operatively attached to the second plate along a barrel member; and at least one fastener engageable with the first plate of the z-bar member, the fastener comprising a shaft and a head extending from one end of the shaft;

wherein the first plate comprises at least one mounting aperture extending lengthwise in a direction of an axis that is generally perpendicular to the longitudinal axis of the z-bar member;

wherein the at least one mounting aperture comprises a first opening and a second opening separated by an intermediate opening, wherein the first opening, second opening, and intermediate opening are aligned along the axis of the aperture;

wherein the first opening is larger than the second opening, and wherein the intermediate opening is smaller than both the first opening and the second opening;

wherein the first opening of each of the mounting apertures is located further from the barrel member than the second opening of each of the mounting apertures;

wherein each mounting aperture has an outer shape that is symmetric about its respective axis; and wherein the intermediate opening of each aperture is smaller than the head of the fastener.

2. The system of claim 1, wherein the barrel member to which the first and second plates are operatively attached comprises an open barrel extending parallel to the longitudinal axis and along at least a portion of the length of the z-bar member, the open barrel comprising a curved portion having a first end and a second end.

3. The system of claim 2, wherein the web portion extends from the first end of the open barrel in a first direction and the flange portion extends from the second end of the open barrel in a second direction, and wherein the first plate of the web portion is generally perpendicular to the second plate of the flange portion.

4. The system of claim 1, wherein the z-bar member further comprises at least one hinge member positioned on the barrel member and in coaxial alignment with the barrel member, wherein each hinge member is spaced longitudinally from each of the at least one mounting apertures.

5. The system of claim 1, wherein the first plate of the web portion is generally perpendicular to the second plate of the flange portion.

6. The system of claim 1, wherein said first opening is sized to accept passage of an outer diameter of the fastener head.

7. The system of claim 1, wherein the second opening is smaller in at least one dimension than an outer diameter of the fastener head.

8. They system of claim 4, in combination with a door, wherein each of the hinge members comprises at least one leaf configured for attachment to an outer edge of the door.

9. A z-bar member for mounting a door to a structural member, the z-bar member comprising:

a longitudinal axis extending along a length of the z-bar member;

a first plate for mounting to a first surface of the structural member, the first plate extending in a first direction relative to the longitudinal axis; and a second plate for positioning against a second surface of the structural member, the second plate extending in a second direction that is generally perpendicular to the first direction, wherein the second plate is operatively attached to the first plate along a barrel member; and at least one mounting aperture extending through the first plate in a direction of an axis that is generally perpendicular to the longitudinal axis of the z-bar member;

wherein the at least one mounting aperture comprises a first opening and a second opening separated by an intermediate opening, wherein the first opening, second opening, and intermediate opening are aligned along the axis of the aperture;

wherein the first opening is larger than the second opening, and wherein the intermediate opening is smaller than both the first opening and the second opening;

wherein the first opening is located further from the barrel surface than the second opening;

wherein each mounting aperture has an outer shape that is symmetric about its respective axis; and wherein the intermediate opening of each aperture is smaller than the head of the fastener.

10. The z-bar member of claim 9, further comprising a projecting portion extending in a generally perpendicular direction from an end of the first plate, wherein the projecting portion comprises a registration surface against which a door can be seated.

* * * * *